US012421983B1

(12) United States Patent
Li et al.

(10) Patent No.: US 12,421,983 B1
(45) Date of Patent: Sep. 23, 2025

(54) ELECTRIC FAN WITH MULTIPLE MOUNTING MODES

(71) Applicant: Dongguan Biyi Electronic Technology Co., Ltd., Dongguan (CN)

(72) Inventors: Song Li, Dongguan (CN); Wentao Hu, Dongguan (CN)

(73) Assignee: Dongguan Biyi Electronic Technology Co., Ltd., Dongguan (CN)

( * ) Notice: Subject to any disclaimer, the term of this patent is extended or adjusted under 35 U.S.C. 154(b) by 0 days.

(21) Appl. No.: 19/055,005

(22) Filed: Feb. 17, 2025

(30) Foreign Application Priority Data

Jan. 13, 2025 (CN) ..... 202520078363.0

(51) Int. Cl.
*F04D 29/64* (2006.01)
*F04D 29/70* (2006.01)
*F04D 19/00* (2006.01)

(52) U.S. Cl.
CPC ..... *F04D 29/644* (2013.01); *F04D 29/705* (2013.01); *F04D 19/002* (2013.01)

(58) Field of Classification Search
CPC ..... F04D 29/705
See application file for complete search history.

(56) References Cited

U.S. PATENT DOCUMENTS

2025/0215898 A1* 7/2025 Harris ..... F04D 29/646

FOREIGN PATENT DOCUMENTS

| | | | |
|---|---|---|---|
| CN | 211230882 U | | 8/2020 |
| CN | 214499535 U | * | 10/2021 |
| CN | 218151519 U | | 12/2022 |
| CN | 221648413 U | | 9/2024 |

OTHER PUBLICATIONS

Nuerst Clip on Fan, "10000mAh 30hrs Portable Fan Rechargeable, 8-Inch Battery Operated Clip on Fan". Found online Jul. 21, 2025 at amazon.com. Reference dated Jan. 13, 2024. Retrieved from https://www.amazon.com/10000mAh-Rechargeable-Portable-Operated-Treadmill/dp/B0CS9FSW25/ (Year: 2024).*

* cited by examiner

*Primary Examiner* — Danielle M. Christensen
(74) *Attorney, Agent, or Firm* — Nitin Kaushik

(57) ABSTRACT

The present invention relates to an electric fan with multiple mounting modes, including a fan head, a support frame, and a base. The base includes a clamping assembly and a suction cup assembly, the clamping assembly includes an upper clamping plate, a lower clamping plate, and an elastic component, and the upper clamping plate is elastically connected to the lower clamping plate through the elastic component. The suction cup assembly is fixed to a lower end of the upper clamping plate. The fan head is movably erected on the support frame, and the support frame is fixed to the upper clamping plate. The suction cup assembly and a force-returning binding band are designed between the upper clamping plate and the lower clamping plate. The fan is adsorbed onto a glass surface by using the suction cup assembly when clamped on a windshield of a golf cart.

10 Claims, 6 Drawing Sheets

ELECTRIC FAN WITH MULTIPLE MOUNTING MODES

CROSS-REFERENCE TO RELATED APPLICATIONS

The application claims priority to Chinese patent application No. 2025200783630, filed on Jan. 31, 2025, the entire contents of which are incorporated herein by reference.

TECHNICAL FIELD

The present invention relates to the technical field of fans, and specifically, to an electric fan with multiple mounting modes.

BACKGROUND

A fan refers to a tool used to generate wind for cooling on hot days, which is a device driven by electricity to generate airflow. Blades configured in the fan rotate to generate natural wind for cooling after powered on. A main component of an electric fan is an AC motor, and for the AC motor, a working principle is that: an electrified coil rotates under force in a magnetic field; and an energy conversion form is that: electrical energy is mainly converted into mechanical energy, and at the same time, due to the resistance of the coil, it is inevitable that a part of the electrical energy will be converted into heat energy.

An existing clip fan for a golf cart has a problem of not being able to be clamped tightly. When the cart is driving on a bumpy road, a fan clip is easy to slide to enable a fan head to fall off. To solve this usage problem, a new clip structure is to be designed to solve the problem of the existing clip fan.

SUMMARY

To overcome deficiencies and defects in the prior art, a purpose of the present invention is to provide an electric fan with multiple mounting modes. A suction cup assembly and a force-returning binding band are designed between an upper clamping plate and a lower clamping plate. The fan is adsorbed onto a glass surface by using the suction cup assembly when clamped on a windshield of a golf cart. In this way, most of the all-direction stress obtained when the cart is bumpy is absorbed by the suction cup assembly made of soft silicone, so that the fan does not move on the glass. In another case, when a clamping assembly clamps a rod on a body of the golf cart, the force-returning binding band is used to enhance a clamping force, and a fan head does not move as well, thereby further improving practicability of the electric fan.

The purpose of the present invention is implemented through the following technical solutions: an electric fan with multiple mounting modes includes a fan head, a support frame, and a base, where the base includes a clamping assembly and a suction cup assembly, the clamping assembly includes an upper clamping plate, a lower clamping plate, and an elastic component, the upper clamping plate is elastically connected to the lower clamping plate through the elastic component, a lower end surface of the upper clamping plate is provided with an upper silicone pad, and an upper end surface of the lower clamping plate is provided with a lower silicone pad; one end of the suction cup assembly penetrates through the upper silicone pad to be fixed to a lower end of the upper clamping plate and is located between the upper silicone pad and the lower silicone pad; and the fan head is movably erected on the support frame, and a tail end of the support frame is fixed to the upper clamping plate.

Further, the base further includes the force-returning binding band disposed at an opening end of the lower clamping plate, an opening end of the upper clamping plate is provided with a penetrating groove corresponding to the force-returning binding band, a pull rod is disposed in the penetrating groove, and one end of the force-returning binding band can penetrate through the pull rod in the penetrating groove to be fixed.

Further, the lower end surface of the upper clamping plate is provided with an upper clamping groove, and the upper end surface of the lower clamping plate is provided with a lower clamping groove corresponding to the upper clamping groove.

Further, each of the upper clamping plate and the lower clamping plate includes a clamping portion and a pressing portion, and each of an outer surface of the upper clamping plate and an outer surface of the pressing portion of the lower clamping plate is provided with a plurality of anti-slip protrusions.

Further, the support frame is a U-shaped support frame, a bottom portion of the support frame is disposed on a mounting portion, an upper end surface of the upper clamping plate is provided with a mounting groove corresponding to the mounting portion, and the mounting portion is mounted in the mounting groove.

Further, each of upper end portions of the support frame is provided with a connecting hole, the fan head is provided with a connecting column corresponding to the connecting hole, the connecting column is movably inserted into the connecting hole, and the fan head can rotate relative to the support frame.

Further, the fan head includes a fan main body and a water spraying mechanism, the fan main body includes a front air guide net, a rear net cover, a blade, a driving motor, and a control assembly, the driving motor is fixed in the rear net cover, the blade is sleeved on a power output shaft end of the driving motor, the front air guide net and the rear net cover are snap-fitted with each other, the rear net cover is provided with an accommodating cavity, the control assembly is disposed in the accommodating cavity, the driving motor is electrically connected to the control assembly, the water spraying mechanism is sleeved in the front air guide net and is located on an air outlet side of the blade, a middle position of the front air guide net is provided with a central hole, a rubber plug is disposed at the central hole, and water mist generated by the water spraying mechanism is sprayed out through the central hole.

Further, the water spraying mechanism includes a water tank, a water pipe connecting member, and a plurality of water delivery pipes, the water tank is sleeved in the front air guide net, one end of each water delivery pipe is communicated with the water tank, the other end of each water delivery pipe is communicated with the water pipe connecting member, an end portion of the water pipe connecting member is provided with a spraying portion communicated with the water pipe connecting member, an atomization piece is disposed at the spraying portion, a water source flows to the atomization piece for atomization through the water pipe connecting member, and the water mist flows out through the central hole of the front air guide net of the fan main body.

Further, the control assembly includes a rear cover, a PCB board, a battery, and a button, the PCB board and the battery are mounted in the accommodating cavity, the rear cover covers a cavity opening of the accommodating cavity, the button is disposed on the rear cover and is electrically connected to the PCB board, and the battery and the driving motor are electrically connected to the PCB board.

Further, a top portion of the water tank is provided with a water inlet, and a water tank cover is disposed at the water inlet.

Beneficial effects of the present invention are as follows: the suction cup assembly and the force-returning binding band are designed between the upper clamping plate and the lower clamping plate. The fan is adsorbed onto the glass surface by using the suction cup assembly when clamped on the windshield of the golf cart. In this way, most of the all-direction stress obtained when the cart is bumpy is absorbed by the suction cup assembly made of soft silicone, so that the fan does not move on the glass. In another case, when the clamping assembly clamps the rod on the body of the golf cart, the force-returning binding band is used to enhance the clamping force, and the fan head does not move as well, thereby further improving the practicability of the electric fan.

Figure 1:
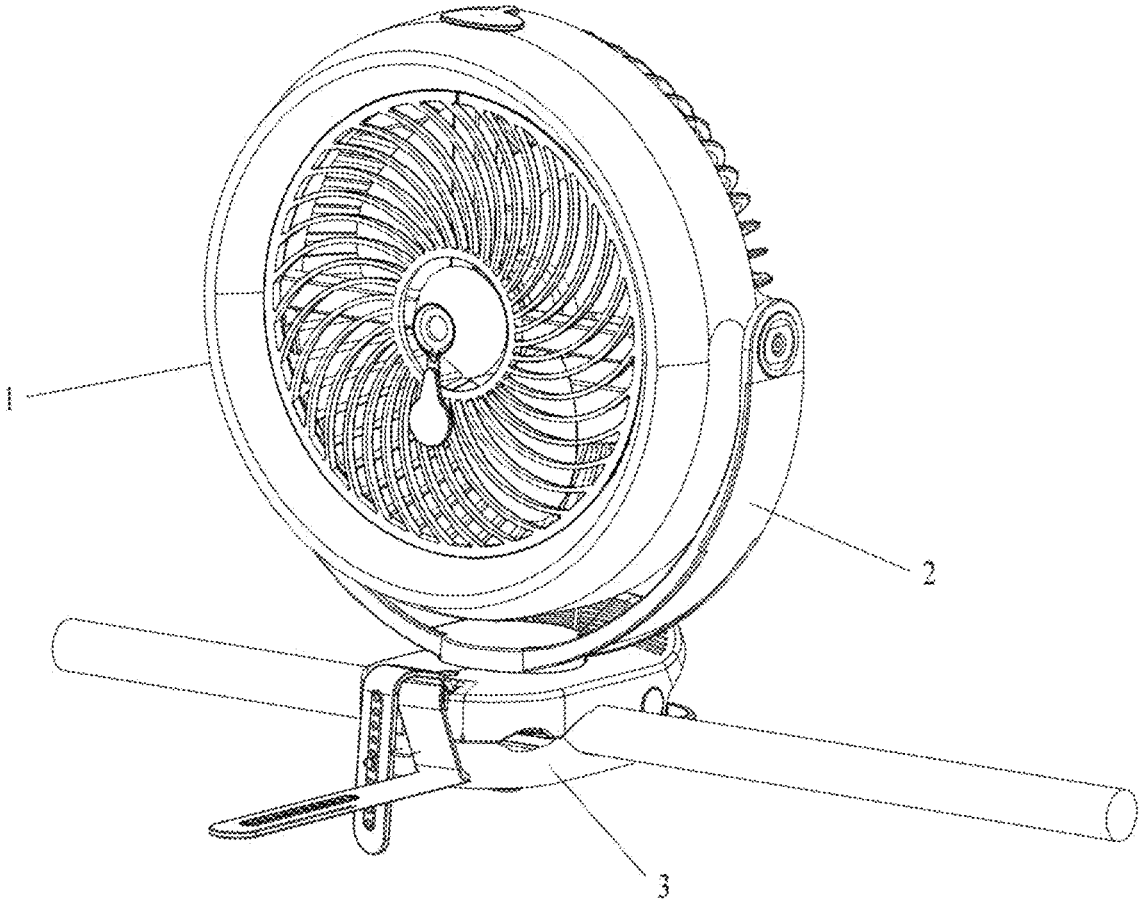
FIG. 1 is a schematic diagram of a first mounting mode of an electric fan according to the present invention.

Reference numerals of the accompanying drawings: 1. fan head; 111. front air guide net; 112. rear net cover; 113. blade; 114. driving motor; 115. connecting column; 116. accommodating cavity; 117. central hole; 118. rubber plug; 121. water tank; 122. water pipe connecting member; 123. water delivery pipe; 124. atomization piece; 125. water inlet; 126. water tank cover; 131. rear cover; 132. PCB board; 133. battery; 134. button; 2. support frame; 21. mounting portion; 22. connecting hole; 3. base; 31. clamping assembly; 311. upper clamping plate; 312. lower clamping plate; 313. elastic component; 314. upper silicone pad; 315. lower silicone pad; 316. upper clamping groove; 317. lower clamping groove; 318. penetrating groove; 319. pull rod; 32. suction cup; 321. pulling-up portion; 33. force-returning binding band; 34. anti-slip protrusion; and 35. mounting groove.

DETAILED DESCRIPTION OF THE EMBODIMENTS

Figure 2:
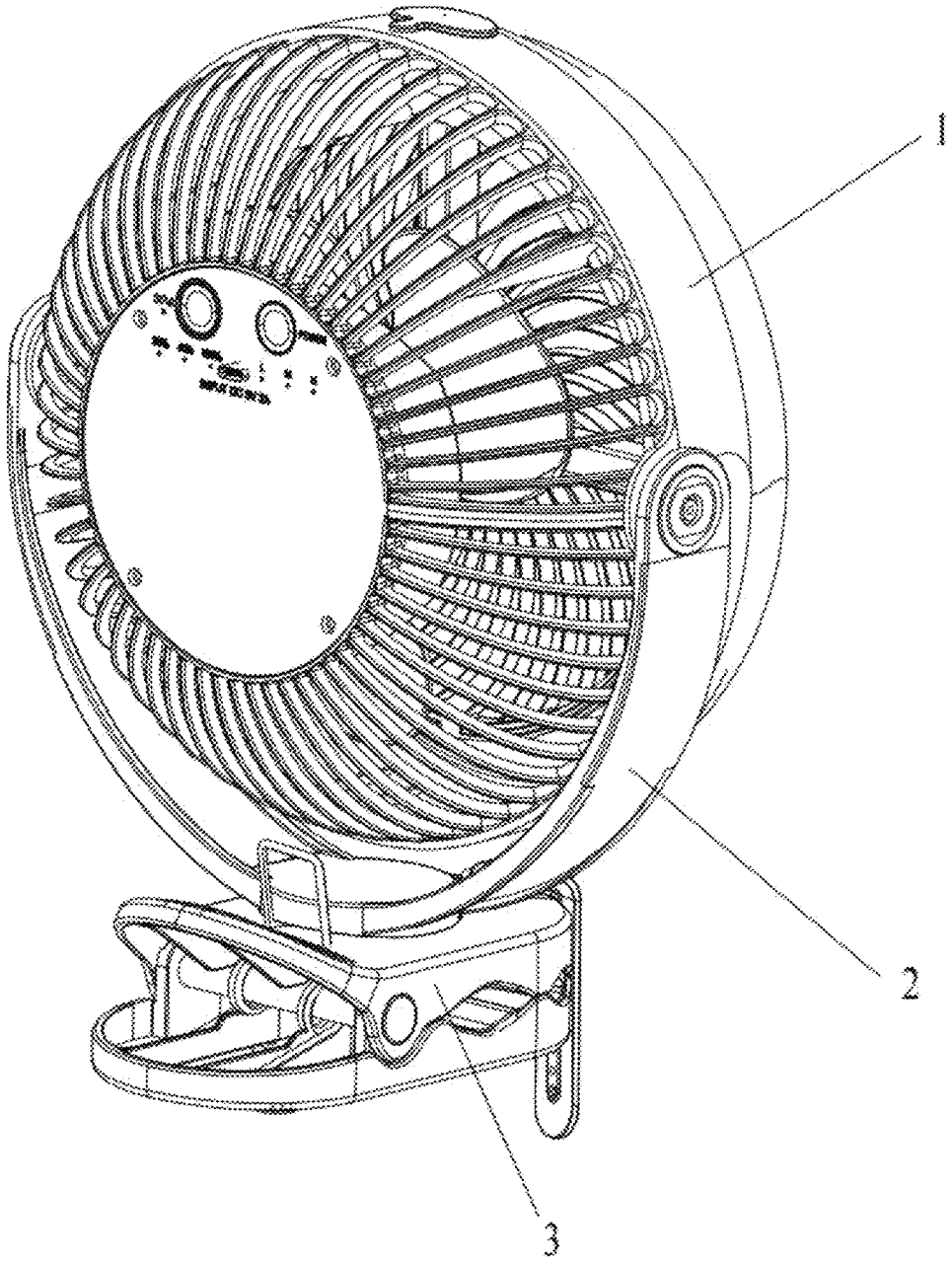
FIG. 2 is a three-dimensional diagram according to the present invention.
Figure 3:
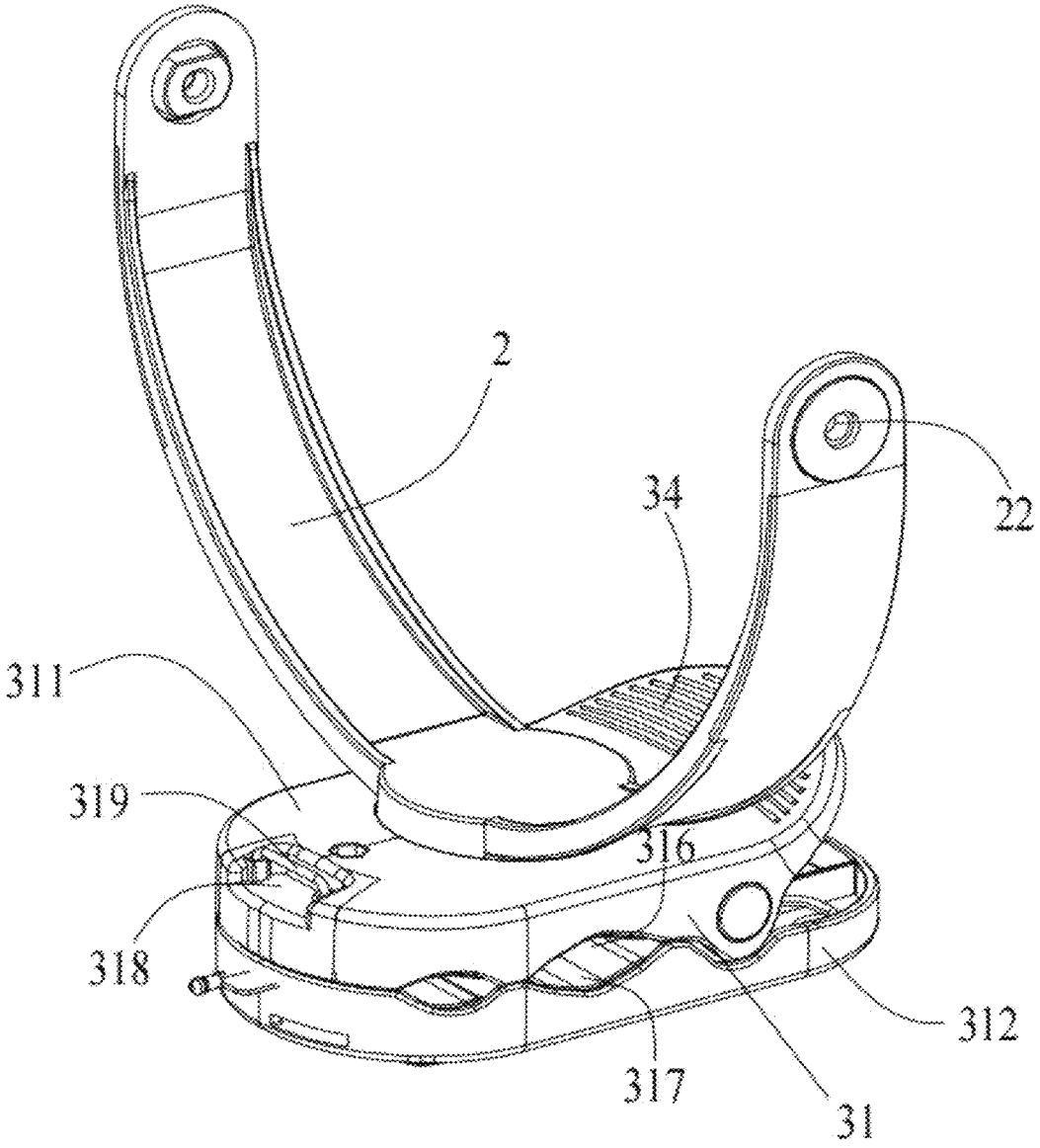
FIG. 3 is a schematic diagram of a combined rotation state of a support frame and a base according to the present invention.
Figure 4:
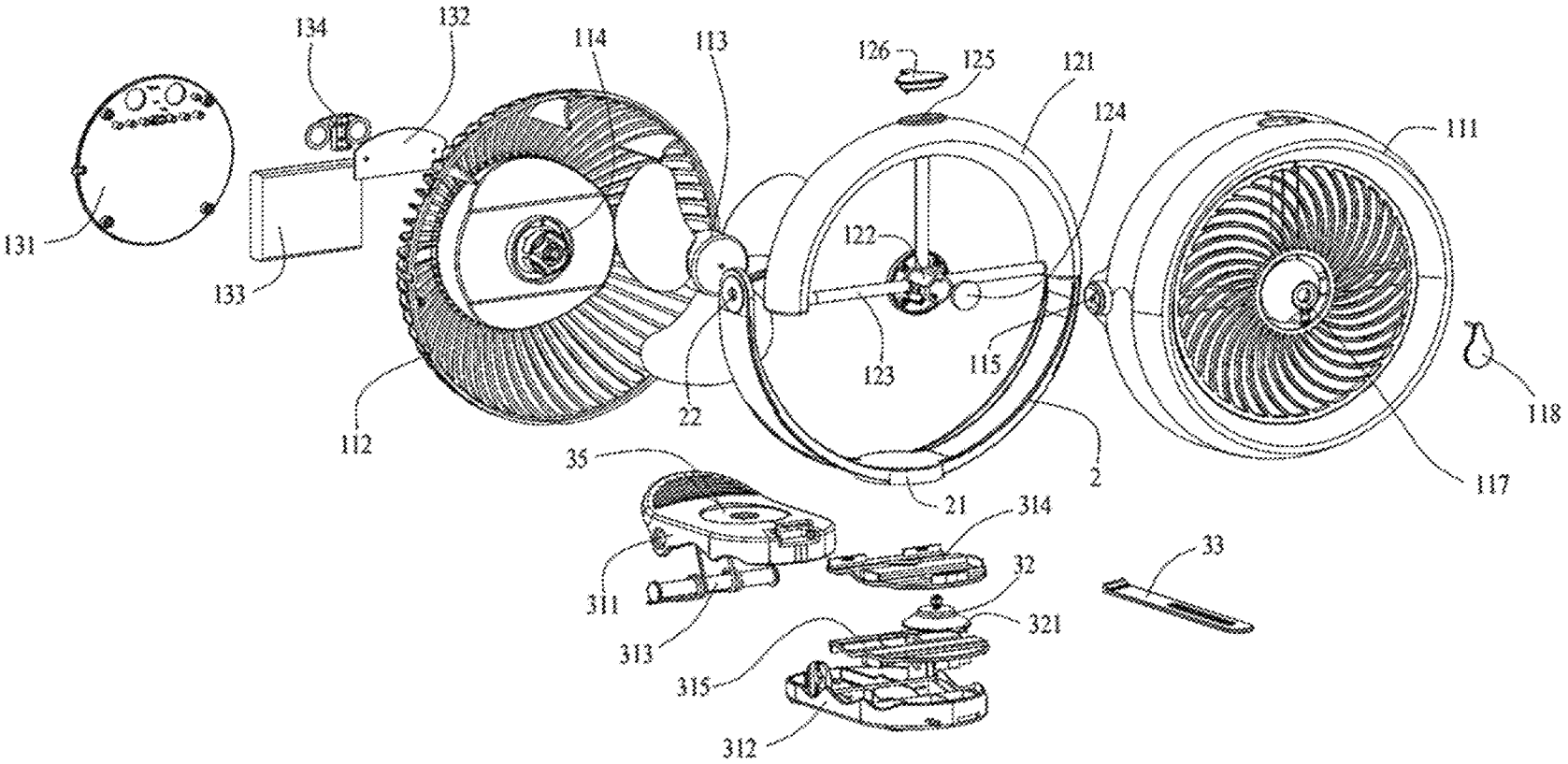
FIG. 4 is a first exploded view according to the present invention.
Figure 5:
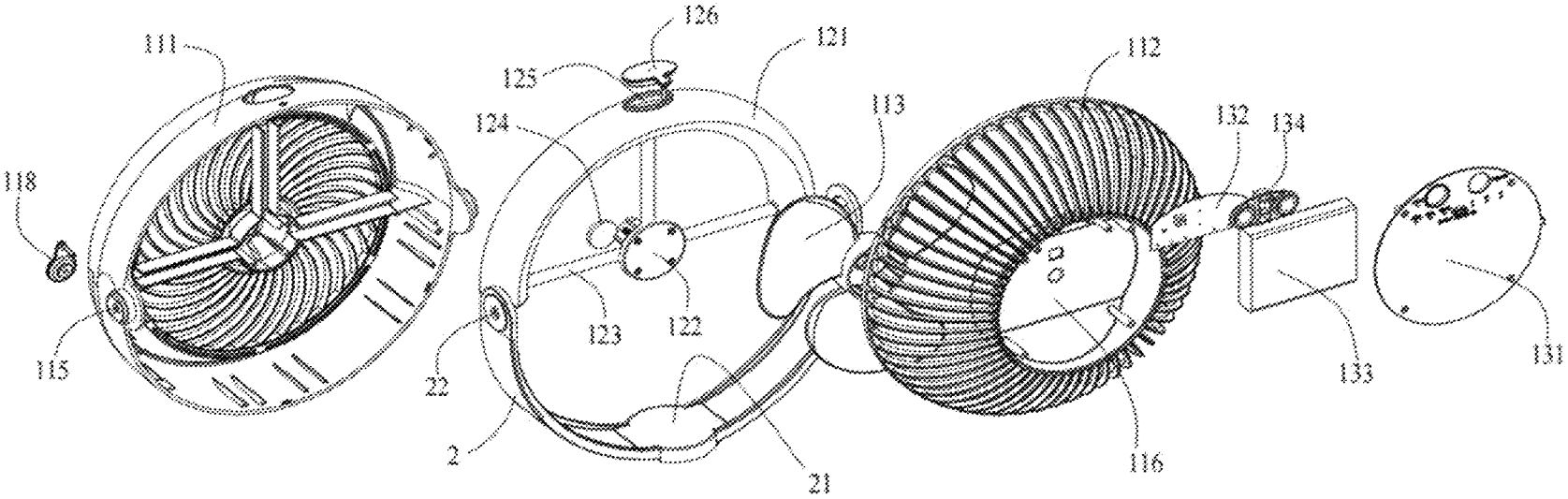
FIG. 5 is a second exploded view according to the present invention.
Figure 6:
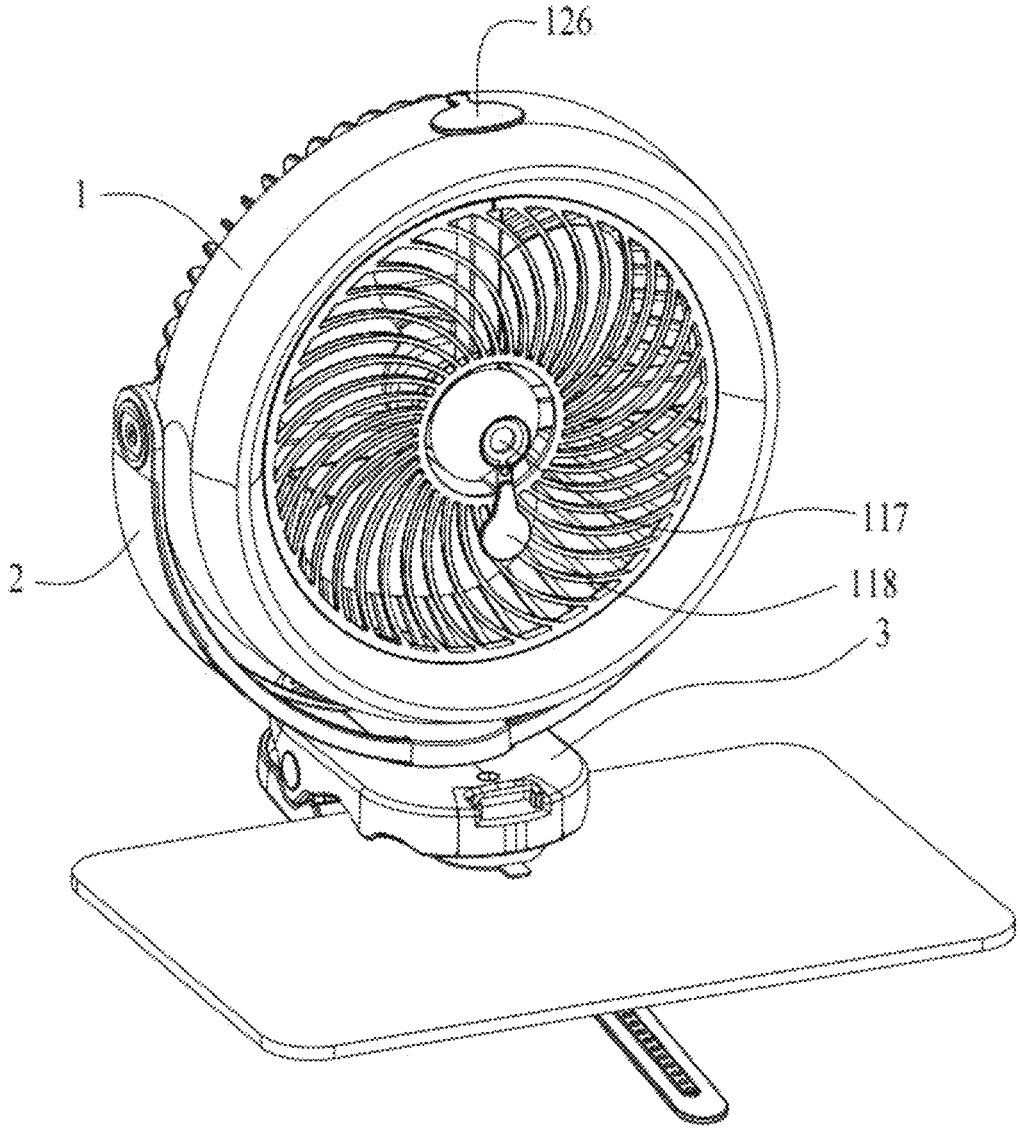
FIG. 6 is a schematic diagram of a second mounting mode of an electric fan according to the present invention.

To facilitate understanding of a person skilled in the art, the present invention is further described below with reference to embodiments and FIGS. 1 to 6, and content mentioned in implementations are not intended to limit the present invention.

Referring to FIG. 1 to FIG. 6, an electric fan with multiple mounting modes includes a fan head 1, a support frame 2, and a base 3. The base 3 includes a clamping assembly 31 and a suction cup 32 assembly, the clamping assembly 31 includes an upper clamping plate 311, a lower clamping plate 312, and an elastic component 313, the upper clamping plate 311 is elastically connected to the lower clamping plate 312 through the elastic component 313, a lower end surface of the upper clamping plate 311 is provided with an upper silicone pad 314, and an upper end surface of the lower clamping plate 312 is provided with a lower silicone pad 315. One end of the suction cup 32 assembly penetrates through the upper silicone pad 314 to be fixed to a lower end of the upper clamping plate 311 and is located between the upper silicone pad 314 and the lower silicone pad 315. The fan head 1 is movably erected on the support frame 2, and a tail end of the support frame 2 is fixed to the upper clamping plate 311. The lower end surface of the upper clamping plate 311 is provided with an upper clamping groove 316, and the upper end surface of the lower clamping plate 312 is provided with a lower clamping groove 317 corresponding to the upper clamping groove 316.

According to the electric fan in the embodiment, the suction cup 32 assembly and a force-returning binding band 33 are designed between the upper clamping plate 311 and the lower clamping plate 312. The fan is adsorbed onto a glass surface by using the suction cup 32 assembly when clamped on a windshield of a golf cart. In this way, most of the all-direction stress obtained when the cart is bumpy is absorbed by the suction cup 32 assembly made of soft silicone, so that the fan does not move on the glass. In another case, when the clamping assembly 31 clamps a rod on a body of the golf cart, the force-returning binding band 33 is used to enhance a clamping force, and the fan head 1 does not move as well, thereby further improving practicability of the electric fan. The clamping assembly 31 is provided with clamping grooves matched with the upper silicone pad 314 and the lower silicone pad 315. The clamping assembly 31 is provided with anti-slip silicone pads, so that a friction force between the clamping assembly 31 and the glass surface or the rod may be improved, to prevent the clamping assembly 31 from displacement after connecting to the glass surface or the rod. In addition, a clamped portion is provided with the clamping grooves matched with the anti-slip silicone pads, and the silicone pads may be inserted into the clamping grooves when the clamping assembly 31 clamps the clamped portion, so that connection stability is good. The suction cup 32 disposed in the clamping assembly 31 is disposed on a suction cup 32, and one side of the suction cup 32 is provided with a pulling-up portion 321 (facilitating lifting the suction cup 32 for depressurization to separate the suction cup 32 from an adsorbed object). The fan is adsorbed onto the glass surface by using the suction cup 32 when clamped on the windshield of the golf cart, which may effectively prevent the fan from moving due to impact.

In the embodiment, the base 3 further includes the force-returning binding band 33 disposed at an opening end of the lower clamping plate 312. An opening end of the upper clamping plate 311 is provided with a penetrating groove 318 corresponding to the force-returning binding band 33. A pull rod 319 is disposed in the penetrating groove 318, and one end of the force-returning binding band 33 can penetrate through the pull rod 319 in the penetrating groove 318 to be fixed.

In the embodiment, each of the upper clamping plate 311 and the lower clamping plate 312 includes a clamping portion and a pressing portion, and each of an outer surface of the upper clamping plate 311 and an outer surface of the pressing portion of the lower clamping plate 312 is provided with a plurality of anti-slip protrusions 34, thereby facilitating forcefully opening the clamping assembly 31 by a user.

In the embodiment, the support frame 2 is a U-shaped support frame, a bottom portion of the support frame 2 is disposed on a mounting portion 21, an upper end surface of the upper clamping plate 311 is provided with a mounting groove 35 corresponding to the mounting portion 21, and the mounting portion 21 is mounted in the mounting groove 35. Each of upper end portions of the support frame 2 is provided with a connecting hole 22, the fan head 1 is provided with a connecting column 115 corresponding to the connecting hole 22, the connecting column 115 is movably inserted into the connecting hole 22, and the fan head 1 can rotate relative to the support frame 2.

In the embodiment, the support frame 2 adopts the U-shaped support frame 2, so that the fan head 1 is mounted in U-shaped space of the support frame 2, and the fan head 1 can rotate around the connecting column 115 in the U-shaped space of the support frame 2. A rotatable angle of the fan head 1 in the U-shaped space is from 0° to 360°. The fan head 1 rotates to adjust an angle direction of an air outlet surface of the fan head 1, and the support frame 2 can rotate relative to the base 3 at the same time, so that a requirement of the user is met.

In the embodiment, the fan head 1 includes a fan main body and a water spraying mechanism. The fan main body includes a front air guide net 111, a rear net cover 112, a blade 113, a driving motor 114, and a control assembly. The driving motor 114 is fixed in the rear net cover 112, the blade 113 is sleeved on a power output shaft end of the driving motor 114, the front air guide net 111 and the rear net cover 112 are snap-fitted with each other, and the rear net cover 112 is provided with an accommodating cavity 116. The control assembly is disposed in the accommodating cavity 116, the driving motor 114 is electrically connected to the control assembly, and the water spraying mechanism is sleeved in the front air guide net 111 and is located on an air outlet side of the blade 113. A middle position of the front air guide net 111 is provided with a central hole 117, and a rubber plug 118 is disposed at the central hole 117. Water mist generated by the water spraying mechanism is sprayed out through the central hole 117, and the rubber plug 118 may be used to cover the central hole 117 when the water mist is not needed.

In the embodiment, the water spraying mechanism includes a water tank 121, a water pipe connecting member 122, and a plurality of water delivery pipes 123. The water tank 121 is sleeved in the front air guide net 111, one end of each water delivery pipe 123 is communicated with the water tank 121, and the other end of each water delivery pipe 123 is communicated with the water pipe connecting member 122. An end portion of the water pipe connecting member 122 is provided with a spraying portion communicated with the water pipe connecting member 122, and an atomization piece 124 is disposed at the spraying portion. By using a principle that water flows downward due to self weight, a water source flows to the atomization piece 124 for atomization through the water pipe connecting member 122, and the water mist flows out through the central hole 117 of the front air guide net 111 of the fan main body, so that an effective cooling effect of the fan with spraying is implemented, skin is moisturized, a cooling speed is fast, and control is flexible. Airflow is accelerated while lowering a temperature, which effectively plays a cooling role.

In the embodiment, the control assembly includes a rear cover 131, a PCB board 132, a battery 133, and a button 134. The PCB board 132 and the battery 133 are mounted in the accommodating cavity 116, the rear cover 131 covers a cavity opening of the accommodating cavity 116, and the button 134 is disposed on the rear cover 131 and is electrically connected to the PCB board 132. The rear cover 131 is further provided a USB charging interface, and the battery 133 and the driving motor 114 are electrically connected to the PCB board 132.

In the embodiment, a top portion of the water tank 121 is provided with a water inlet 125, and a water tank cover 126 is disposed at the water inlet 125.

The foregoing embodiments are preferred implementations of the present invention. In addition, the present invention may be implemented in another manner, and any obvious replacement without departing from the concept of the present invention shall fall within the protection scope of the present invention.

What is claimed is:

1. An electric fan with multiple mounting modes, comprising a fan head, a support frame, and a base, wherein the base comprises a clamping assembly and a suction cup assembly, the clamping assembly comprises an upper clamping plate, a lower clamping plate, and an elastic component, the upper clamping plate is elastically connected to the lower clamping plate through the elastic component, a lower end surface of the upper clamping plate is provided with an upper silicone pad, and an upper end surface of the lower clamping plate is provided with a lower silicone pad; one end of the suction cup assembly penetrates through the upper silicone pad to be fixed to a lower end of the upper clamping plate and is located between the upper silicone pad and the lower silicone pad; and the fan head is movably erected on the support frame, and a tail end of the support frame is fixed to the upper clamping plate.

2. The electric fan with multiple mounting modes according to claim 1, wherein the base further comprises a force-returning binding band disposed at an opening end of the lower clamping plate, an opening end of the upper clamping plate is provided with a penetrating groove corresponding to the force-returning binding band, a pull rod is disposed in the penetrating groove, and one end of the force-returning binding band can penetrate through the pull rod in the penetrating groove to be fixed.

3. The electric fan with multiple mounting modes according to claim 1, wherein the lower end surface of the upper clamping plate is provided with an upper clamping groove, and the upper end surface of the lower clamping plate is provided with a lower clamping groove corresponding to the upper clamping groove.

4. The electric fan with multiple mounting modes according to claim 1, wherein each of the upper clamping plate and the lower clamping plate comprises a clamping portion and a pressing portion, and each of an outer surface of the upper clamping plate and an outer surface of the pressing portion of the lower clamping plate is provided with a plurality of anti-slip protrusions.

5. The electric fan with multiple mounting modes according to claim 1, wherein the support frame is a U-shaped support frame, a bottom portion of the support frame is disposed on a mounting portion, an upper end surface of the upper clamping plate is provided with a mounting groove corresponding to the mounting portion, and the mounting portion is mounted in the mounting groove.

6. The electric fan with multiple mounting modes according to claim 5, wherein each upper end portion of the support frame is provided with a corresponding connecting hole, the fan head is provided with a connecting column corresponding to each connecting hole, each connecting column is movably inserted into their respective connecting hole, and the fan head can rotate relative to the support frame.

7. The electric fan with multiple mounting modes according to claim 1, wherein the fan head comprises a fan main body and a water spraying mechanism, the fan main body comprises a front air guide net, a rear net cover, a blade, a driving motor, and a control assembly, the driving motor is fixed in the rear net cover, the blade is sleeved on a power output shaft end of the driving motor, the front air guide net and the rear net cover are snap-fitted with each other, the rear net cover is provided with an accommodating cavity, the control assembly is disposed in the accommodating cavity, the driving motor is electrically connected to the control assembly, the water spraying mechanism is sleeved in the front air guide net and is located on an air outlet side of the blade, a middle position of the front air guide net is provided with a central hole, and water mist generated by the water spraying mechanism is sprayed out through the central hole.

8. The electric fan with multiple mounting modes according to claim 7, wherein the water spraying mechanism comprises a water tank, a water pipe connecting member, and a plurality of water delivery pipes, the water tank is sleeved in the front air guide net, one end of each water delivery pipe is communicated with the water tank, the other end of each water delivery pipe is communicated with the water pipe connecting member, an end portion of the water pipe connecting member is provided with a spraying portion communicated with the water pipe connecting member, an atomization piece is disposed at the spraying portion, a water source flows to the atomization piece for atomization through the water pipe connecting member, and the water mist flows out through the central hole of the front air guide net of the fan main body.

9. The electric fan with multiple mounting modes according to claim 8, wherein a top portion of the water tank is provided with a water inlet, and a water tank cover is disposed at the water inlet.

10. The electric fan with multiple mounting modes according to claim 7, wherein the control assembly comprises a rear cover, a PCB board, a battery, and a button, the PCB board and the battery are mounted in the accommodating cavity, the rear cover covers a cavity opening of the accommodating cavity, the button is disposed on the rear cover and is electrically connected to the PCB board, and the battery and the driving motor are electrically connected to the PCB board.

* * * * *